US006597330B1

(12) United States Patent
Hayashi et al.

(10) Patent No.: US 6,597,330 B1
(45) Date of Patent: Jul. 22, 2003

(54) PLASMA ADDRESSED DISPLAY DEVICE

(75) Inventors: Masatake Hayashi, Gifu (JP); Hiroshi Itou, Chiba (JP)

(73) Assignees: Sony Corporation, Tokyo (JP); Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/391,804

(22) Filed: Sep. 8, 1999

(30) Foreign Application Priority Data

Sep. 8, 1998 (JP) ..... 10-253145

(51) Int. Cl.[7] ..... G09G 3/28

(52) U.S. Cl. ..... 345/60; 345/63; 315/169.3; 313/582; 349/32

(58) Field of Search ..... 345/60, 63, 67–68, 345/208–209, 87–89, 204; 349/32, 145, 156; 315/169.1, 169.3, 169.4; 313/582, 584

(56) References Cited

U.S. PATENT DOCUMENTS 5,570,104 A * 10/1996 Hayashi ..... 313/484
6,011,355 A * 1/2000 Nagai ..... 315/169.3
6,181,305 B1 * 1/2001 Nguyen et al. ..... 315/169.4
6,326,937 B1 * 12/2001 Hayashi ..... 313/582

* cited by examiner

*Primary Examiner*—Richard Hjerpe
*Assistant Examiner*—Francis Nguyen
(74) *Attorney, Agent, or Firm*—Sonnenschein, Nath & Rosenthal

(57) ABSTRACT

A plasma addressed display device includes a flat panel, a scanning circuit and a signal circuit. The flat panel is of a superimposed structure of a plasma cell having scanning electrodes in a row configuration and a display cell having scanning electrodes in a column configuration. The scanning circuit sequentially applies selection pulses to the scanning electrode to scan the display panel. The signal circuit writes the picture data in the signal electrode in synchronism with this scanning. On the plasma cells, there are formed reciprocally isolated discharge channels in a row configuration. To each discharge channel, charged with an electrically dischargeable gas, are allotted plural scanning electrodes. As characteristic of the present invention, the scanning circuit sequentially applies the selection pulses to the scanning electrode allotted to a sole discharge channel to produce electrical discharge to form at least two scanning lines to a sole discharge channel. This realizes a high open area ratio and high resolution of the plasma addressed display device.

2 Claims, 5 Drawing Sheets

FIG. 5A
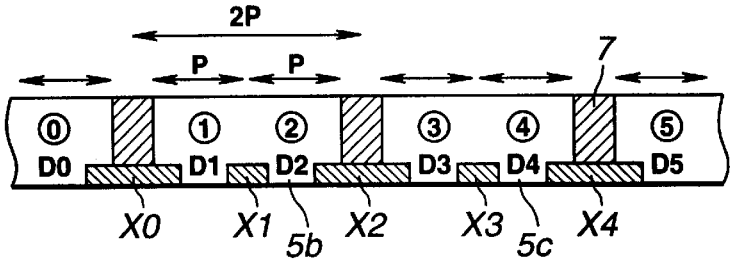
FIG. 5B
PRIOR ART
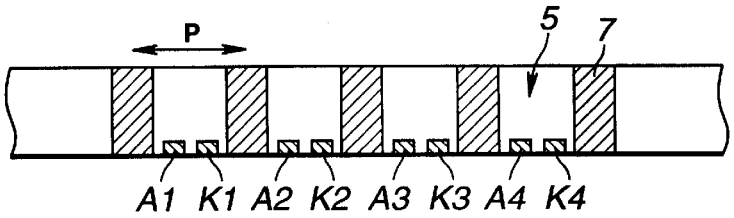
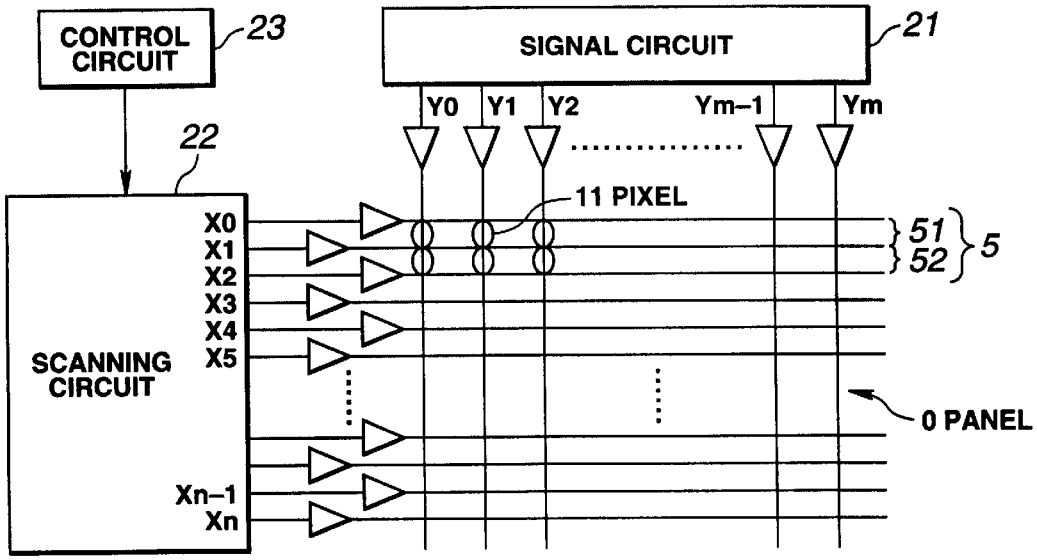
FIG. 6

PLASMA ADDRESSED DISPLAY DEVICE

BACKGROUND OF THE INVENTION

1. Field of the Invention

This invention relates to a plasma addressed display device including a flat panel having a display cell and a plasma cell, that one overlapped, and a peripheral area. More particularly, it relates to a technique for achieving high resolution of scanning lines formed in the plasma cell.

2. Description of the Related Art

The structure of a plasma addressed display device, disclosed in, for example, the Japanese Laying-Open Patent H-4-265931, is shown in FIG. 1. As shown therein, the plasma addressed display device is of a flat panel structure comprised of a display cell 1, a plasma cell 2 and a common intermediate sheet 3 interposed therebetween. The intermediate sheet 3 is formed by an ultra-thin glass plate, termed a micro-sheet. The plasma cell 2 is made up of a lower glass substrate 4, connected to the intermediate sheet 3, and a dischargeable gas is sealed in a gap defined therebetween. On the inner surface of the lower glass substrate 4 are formed stripe-shaped scanning electrodes operating as anodes A and cathodes K arranged as sets. Plural barrier ribs 7 are provided for demarcating the sets of the anodes A and the cathodes K from one another. The gap charged with the dischargeable gas is split by these barrier ribs to delimit discharge channels 5. The neighboring discharge channels 5 are isolated from one another by the barrier ribs 7. These barrier ribs 7 can be printed by the screen printing method, with the top sides of the barrier ribs compressing against the sides of the intermediate sheet 3. Within the discharge channels 5, surrounded by the paired barrier ribs 7, plasma discharge is induced between the anodes A and the cathodes K. The intermediate sheet 3 and the lower glass substrate 4 are interconnected by e.g., glass frit.

The display cell 1 is constituted by a transparent upper glass substrate 8, which is connected to the other surface of the intermediate sheet 3 by a sealant to define a gap. Within this gap is sealed a liquid crystal 9 as an electro-optical material. A signal electrode Y is formed on the inner surface of the upper glass substrate 8. In each intersecting point of the signal electrode Y and the discharge channel 5 is formed a pixel to form a matrix of pixels. On the inner surface of the glass substrate 8, there is provided a color filter 13 to allocate three prime colors R, G and B to each pixel. The flat panel, constructed in this manner, is of a transmission type. For example, the plasma cell 2 and the display cell 1 are arranged on the incident side and on the outgoing side, respectively. On the plasma cell side is mounted a backlight 12.

With the above-described plasma addressed display device, the row-shaped discharge channels 5 in which occurs plasma discharge, are switched and scanned line-sequentially, while picture data are applied to column-shaped signal electrodes Y on the display cell side in synchronism with the scanning to effect display driving. If plasma discharge occurs in the discharge channels 5, the inside of the discharge channel 5 is at an anode potential substantially uniformly to effect pixel selection on the scanning line basis. That is, each discharge channel 5 corresponds to a scanning line and operates as a sampling switch. If, with the plasma sampling switch on, pixel data is applied to each pixel, sampling takes place to control the pixel turning on or off. With the sampling switch turned off, the pixel data are held in the pixels. That is, in the display cell 1, the incident light from the backlight 12 is modulated into outgoing light, depending on the picture data, to display a picture.

FIG. 2 shows only two pixels 11. For assisting in the understanding, only two signals electrodes Y1, Y2, a sole cathode K1 and a sole anode A1 are shown. Each pixel 11 has a layered structure of the signals electrodes Y1, Y2, a liquid crystal 9, an intermediate sheet 3 and a discharge channel 5. The discharge channel is connected substantially to the anode potential during plasma discharge. If, in this state, picture data is applied across the signal electrodes Y1, Y2, electrical charges are implanted into the liquid crystal 9 and the intermediate sheet 3. On termination of the plasma discharge, the discharge channel is restored to the insulated state, so that the potential is the floating potential such that the implanted electrical charges are held in the respective pixels by way of effecting the sample-and-hold operation. Since the discharge channel operates as a sampling switch element provided in each pixel, it is depicted symbolically by a switching symbol S1. On the other hand, the liquid crystal 9 and the intermediate sheet 3, held between the signal electrodes Y1, Y2 and the discharge channel, operate as sampling capacitors. If, by line-sequential scanning, the sampling switch S1 is in a conducting state, picture data is written in the sampling capacitors, such that the respective pixels are turned on or off depending on the data voltage level. After the sampling switch S1 is in the non-conducting state, the data voltage is held in the sampling capacitor to effect the active matrix operation of the display device. Meanwhile, the effective voltage applied to the liquid crystal 9 is decided by capacity division with respect to the intermediate sheet 3.

In the above-described plasma addressed display device, if the picture is to be improved in resolution, the pixels arranged in a matrix configuration need to be increased in pixel density. For reducing the pixel size in the horizontal direction, that is in the row direction, it suffices to reduce the line width of the column-shaped signal electrodes. On the other hand, for reducing the pixel size in the vertical direction, that is in the column direction, it suffices to reduce the arraying pitch of the row-shaped discharge channel. However, the respective discharge channels are isolated from one another by the barrier ribs. Due to limitations in the machining techniques, it is difficult to reduce the thickness of the barrier ribs drastically, such that there is set a minimum thickness for assuring e.g., mechanical strength. Therefore, if the arraying pitch of the discharge channels is diminished, the area taken up by the thickness of the barrier ribs is relatively increased to diminish the area of the opening through which is transmitted the light. Stated differently, the larger the number of the discharge channels, that is the scanning lines, the lower is the open area ratio in the panel. Moreover, since the barrier ribs are of a certain height, these obstruct the obliquely incident light rays. Thus, the shorter the arraying pitch of the barrier ribs, the larger is the ratio of obstruction of the obliquely incident light, thus leading to the narrow viewing angle from the viewer.

If it is attempted to reduce the arraying pitch in the plasma addressed display device, the open area ratio is necessarily reduced due to limitations in the manufacturing process of the barrier ribs or scanning electrodes. The result is insufficient brightness of the display. If, for compensation, the light emitting volume of the backlight is increased, the power consumption is increased. If the barrier ribs or the electrode structures are reduced in size, the rate of occurrence of defects is necessarily increased, thus giving rise to the incompatibility between the productivity and the opening area ratio. For example, in the plasma cell structure shown in FIG. 3, the arraying pitch of the discharge channels 5 is 1000 μm, with the width of the barrier ribs 7 being 200 μm and with the width of the anode A or the cathode K being 200 μm. Thus, the open area ratio, of the illustrated panel is 1−(200+200+200)/1000=0.4, or 40%. If the arraying pitch is reduced from 1000 μm to 700 μm, the open area ratio is as low as 1−(200+200+200)/700=0.14 or 14%. In such case, the open area ratio can be raised to a limited extent by reducing the electrode width of the anode A or the cathode K. However, if the electrode width is reduced, the production yield is lowered due to line breakage to lower the productivity significantly.

SUMMARY OF THE INVENTION

It is therefore an object of the present invention to overcome the above-mentioned disadvantages in the prior art.

A plasma addressed display device includes a flat panel, a scanning circuit and a signal circuit. The flat panel is of a superimposed structure of a plasma cell having scanning electrodes in a row configuration and a display cell having scanning electrodes in a column configuration. The scanning circuit sequentially applies selection pulses to the scanning electrode to scan the display panel. The signal circuit writes picture data in the signal electrode in synchronism with this scanning. On the plasma cells, there are formed reciprocally isolated discharge channels in a row configuration. To each discharge channel, charged with an electrically dischargeable gas, are allotted plural scanning electrodes. As characteristic of the present invention, the scanning circuit sequentially applies the selection pulses to the scanning electrode allotted to a sole discharge channel to produce electrical discharge to form at least two scanning lines to a sole discharge channel. This realizes a high opening area ratio and high resolution of the plasma addressed display device. The signal circuit writes picture data of the same polarity on two scanning lines, that is the forward scanning line and the backward scanning line, while writing picture data of opposite polarity to the two scanning lines, that is forward and backward scanning lines, belonging to a sole discharge channel, to effect AC driving of the display cell. As similarly characteristic of the present invention, the signal circuit corrects the picture data written in the backward side one of the forward side and backward side scanning lines affected by the polarity switching in meeting with the picture data of the forward side scanning line not affected by the polarity switching. Stated differently, the picture data written in the respective scanning lines in the discharge channel is corrected at a preset correction value to cancel the effect of the polarity switching.

According to the plasma addressed display device of the present invention, at least two scanning lines, namely a forward side scanning line and a backward side scanning line, are allotted in the reciprocally isolated discharge channels. Since the scanning line density is at least twice that of the conventional device, the pixel can be arrayed at a denser pitch. Conversely, should the same pixel density as that of the conventional device suffice, the arraying pitch of the discharge channels can be at least twice that of the conventional device, thus leading to improved productivity and improved open area ratio. Also, according to the present invention, two scanning lines can be formed per discharge channel by allotting two scanning electrodes, for example, per discharge channel. Conversely, with the conventional plasma cell, a scanning electrode made up of an anode and a cathode is allotted to a sole discharge channel to form a sole scanning line. Thus, if the same number of scanning lines are formed in the conventional device and in the present invention, the number of the scanning electrodes can be one-half that of the conventional device to improve productivity and the open area ratio in a similar manner.

In particular, in the present invention, picture data of the positive polarity, for example, are written in the two scanning lines, that is the forward scanning line and the backward scanning line, belonging to the sole discharge channel, while picture data of the negative polarity are written in the two scanning lines, that is the forward scanning line and the backward scanning line, belonging to the next discharge channel, to effect AC driving of the display cell. This AC driving is effective to prolong the service life of the display cell employing the liquid crystal as an electro-optical substance. In this case, the previously selected forward one of the two scanning lines formed in a sole discharge channel is of the same polarity as the subsequently selected scanning line and hence is not affected by polarity switching which is based on the AC driving. Conversely, the subsequently selected scanning line is affected by the next polarity switching. The result is that, if the picture data written in the posterior scanning line is of the same value as the previous scanning line, the luminance value as actually observed becomes different: In order to prevent this, the picture data written in the posterior scanning line affected by polarity switching is previously corrected in meeting with the picture data written in the previous scanning line not affected by polarity switching.

According to the present invention, at least two scanning lines, that is forward and backward scanning lines, are provided in a sole discharge channel in a plasma addressed display device. For forming at least two scanning lines in the sole discharge channel, at least two scanning electrodes are provided in the sole discharge channel. With this structure, the numbers of the scanning electrodes and the barrier ribs can be reduced to one-half those of the conventional device, thus significantly improving the productivity. On the other hand, the open area ratio can be improved to increase the brightness as a display to reduce the power consumption of the backlight correspondingly. In addition, by halving the number of the barrier ribs, it becomes possible to release limitations on the angle of field of view in the up-and-down direction of the viewing plane to increase the angle of field of view. In particular, if the picture data written in the posterior scanning line affected by polarity switching are corrected in meeting with the picture data written in the previous scanning line not affected by polarity switching, at the time of AC driving of the display cell, the picture display quality can be improved significantly.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

FIG. 5A illustrates the results of writing picture data according to the present invention;

FIG. 5B illustrates the results of writing the picture data in the conventional technique;

FIG. 6 is a circuit diagram showing the entire structure of the plasma addressed display device embodying the present invention;

DESCRIPTION OF THE PREFERRED EMBODIMENTS

Figure 1:
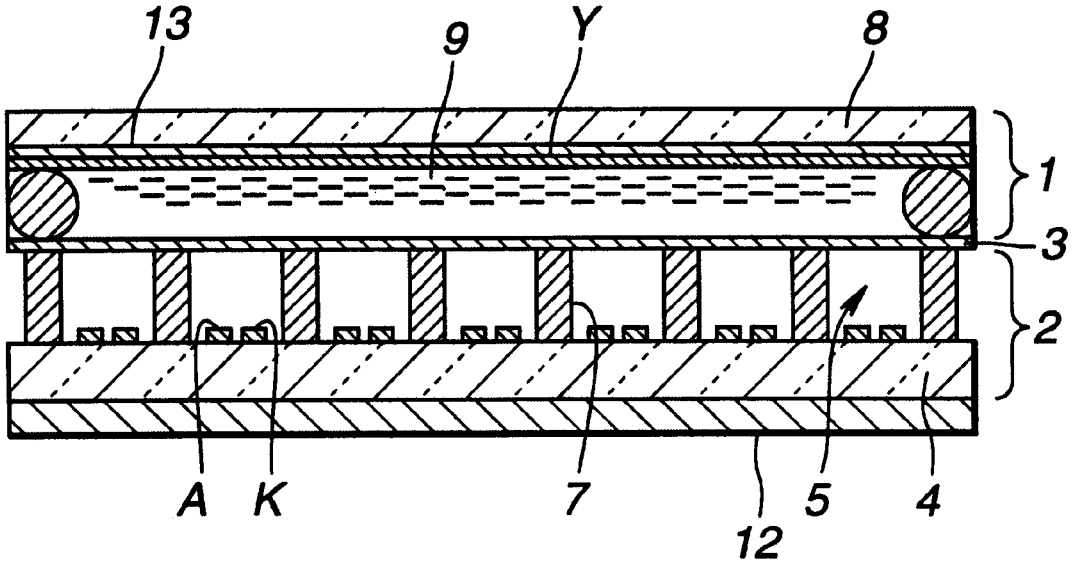
FIG. 1 PRIOR ART
FIG. 1 is a cross-sectional view showing a prior art plasma addressed display device.
Figure 2:
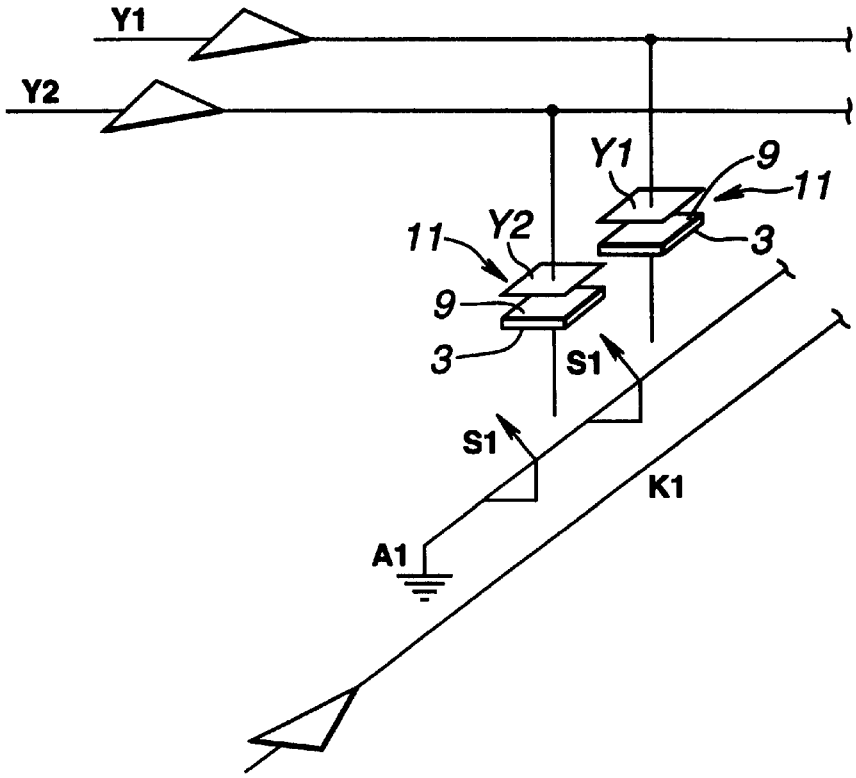
FIG. 2 PRIOR ART
FIG. 2 is a schematic view showing two pixels of the prior art plasma addressed display device.
Figure 3:
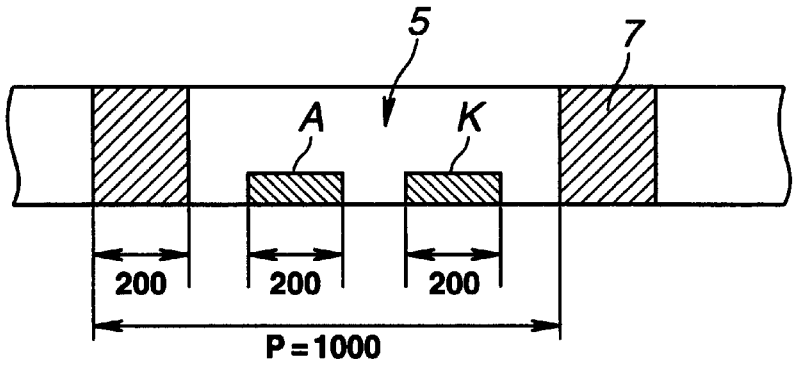
FIG. 3 PRIOR ART
FIG. 3 is a schematic view showing an electrode structure of the prior art plasma addressed display device.
Figure 4A:
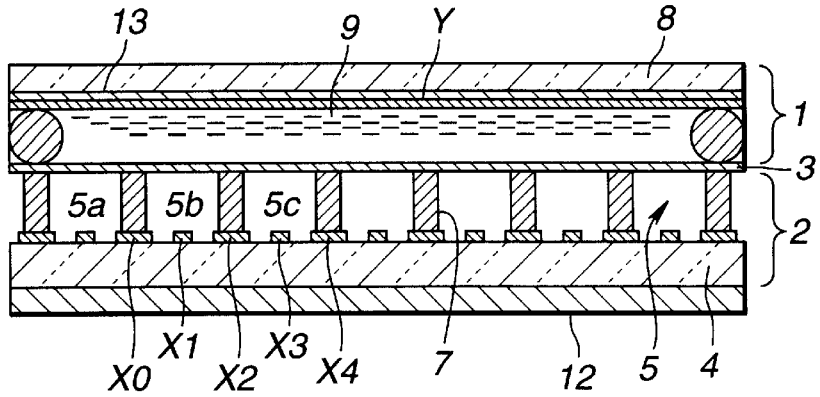
FIG. 4A is a cross-sectional view showing a plasma addressed display device embodying the present invention.
Figure 4B:
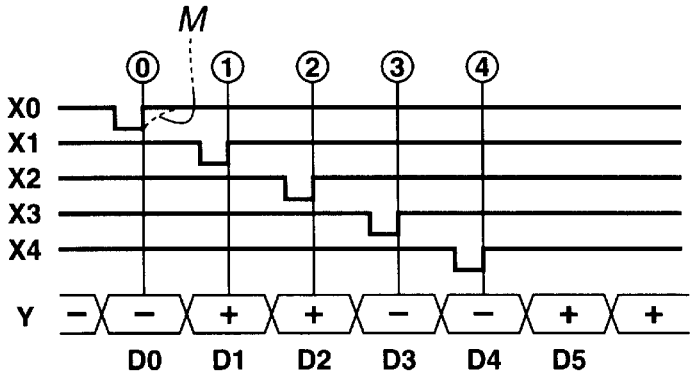
FIG. 4B is a timing chart for illustrating the operation of the plasma addressed display device according to the present invention.
Figure 4C:
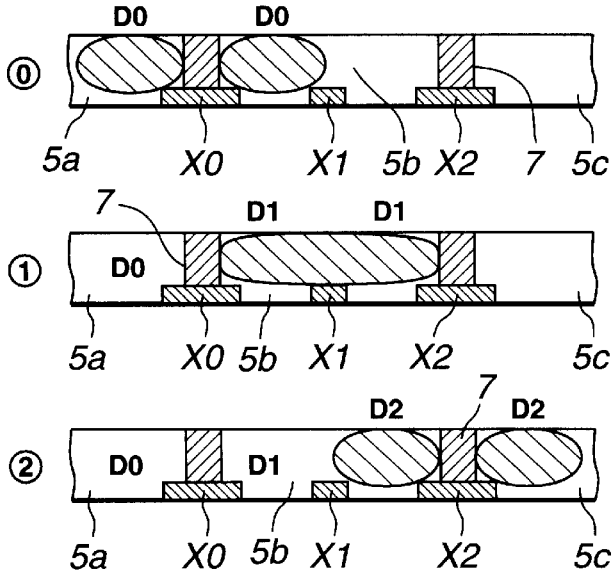
FIG. 4C illustrates the operation of the plasma addressed display device according to the present invention.

FIG. 4A is a cross-sectional view showing a plasma addressed display device according to the present invention, FIG. 4B is a timing chart for illustrating the operation and FIG. 4C is a diagrammatic view similarly showing the operation. Basically, the plasma addressed display device according to the present invention is made up of a flat panel, a peripheral scanning circuit and a peripheral signal circuit. FIG. 4A shows the structure of a flat panel. As shown, the flat panel is of a layered structure of a display cell 1 and a plasma cell 2 superimposed together with a common intermediate sheet 3 interposed therebetween. The plasma cell 2 is comprised of a lower glass substrate 4 bonded to the intermediate sheet 3 and a dischargeable gas, such as xenon gas or a neon gas, is sealed in a space defined in-between. On the inner surface of the lower glass substrate 4 are formed striped scanning electrodes. These scanning electrodes are alternately different in diameter, with the scanning electrodes of the larger diameter being denoted X0, X2, X4, . . . , and with the scanning electrodes of the smaller diameter being denoted X1, X3, . . . . Directly above and along the scanning electrodes X0, X2, X4, . . . of larger diameter, there are formed barrier ribs 7 for delimiting discharge channels 5 by subdividing the spacing charged with the dischargeable gas. As shown, neighboring discharge channels 5 are separated from each other by the barrier ribs 7. These barrier ribs 7 can be thermally printed by the screen printing method, with the top sides of the barrier ribs compressing against the lower side of the intermediate sheet 3. As shown, the neighboring discharge channels 5 are separated from each other by the barrier rib 7. By this structure, two scanning electrodes X1, X2 are allocated to a given discharge channel 5*b*, for example, while scanning electrodes X3, X4 are allocated to a neighboring discharge channel 5*c*.

The display cell 1 is constructed using a transparent upper glass substrate 8. This upper glass substrate 8 is bonded to the upper surface of the intermediate sheet 3 by e.g., a sealant, with a pre-set gap in-between. A liquid crystal 9 is sealed in this gap as an electro-optical substance. On the inner surface of the upper glass substrate 8 is formed a signal electrode Y. In the points of intersection between the signal electrodes Y and the discharge channels 5 are formed pixels in a matrix configuration. On the inner surface of the upper glass substrate 8 is formed a color filter 13 for allotting three prime colors of R, G and B, for example, to the respective pixels. The flat panel having this structure is of the transmission type, with the plasma cell 2 and the display cell 1 being located on the incident and outgoing sides, respectively. The backlight 12 is mounted on the plasma cell 2.

Referring to FIG. 4B, the peripheral scanning circuit sequentially applies selection pulses to the scanning electrodes X0, X1, X2, X3, X4, . . . . The selection pulses are of negative polarity with respect to the grounding potential. In the illustrated example, a selection pulse is applied to the scanning electrode X0 at a 0th timing, a selection pulse is applied to the scanning electrode X1 at a first timing, a selection pulse is applied to the scanning electrode X2 at a second timing, a selection pulse is applied to the scanning electrode X3 at a third timing, selection pulse is applied to the scanning electrode X4 at a fourth timing, and so forth, such that selection pulses are sequentially applied to the respective scanning electrodes X. These respective timings are indicated by numbers entered in circles. On the other hand, the peripheral signal circuit furnishes picture data D to the totality of the signal electrodes Y in timed relation to scanning by the scanning circuit. In the illustrated example, picture data D0 of negative polarity are supplied at the 0th timing, picture data D1, D2 of positive polarity are supplied at the first and second timings, picture data D3, D4 of the negative polarity are supplied at the third and fourth timings, and so forth, to supply the picture data D to the signal electrode Y.

At the 0th timing, the picture data D0 supplied to the signal electrode Y is sampled at a time point the selection pulse applied across the scanning electrode X0 a reverts to the ground level, so as to be written in the pixels for one scanning line. In actuality, data writing is not concurrent with application of the selection pulses, but a decay shown at M is produced, under the effect of metastable particles contained in the plasma. Since picture data is written even in this on, the next picture data D1 is likely to be affected by this writing. At the next first timing, the picture data of the positive polarity D1, applied across the signal electrode Y, is sampled at a time point when the selection pulse applied across the scanning electrode X1 reverts to the ground potential. In a similar manner, the picture data is sampled at the second, third and fourth timings.

FIG. 4C is a schematic view showing chronological changes in the discharge channel at the 0th, first and second timings. First, at the 0th timing, a selection pulse is applied across the scanning electrode X0 located directly below one of the barrier ribs 7. This generates plasma discharge across the scanning electrode X0 and paired scanning electrodes at the ground potential level located on both sides of the scanning electrode X0. In the drawing, this plasma discharge is indicated by hatching. Considering the center discharge channel 5*b*, the left half portion of the discharge channel 5*b* is at an anode potential to form a scanning line. In the pixels of this forward side scanning line are written picture data D0 of the negative polarity. Meanwhile, the picture data D0 of the negative polarity are not allotted inherently to the center discharge channel 5*b*, but are allocated to the left-side discharge channel 5*a*. At the first timing, a selection pulse is applied to the center scanning electrode X1, so that plasma discharge occurs between the scanning electrodes X0 and X2 lying on both sides of the center scanning electrode X1. The result is that two scanning lines, namely a forward side scanning line and a backward side scanning line, are produced, and picture data D1 of positive polarity is written in these scanning lines. That is, the picture data D0 of the negative polarity, written in the forward side scanning line at the 0th timing, is rewritten to the picture data D1 of the positive polarity immediately at the first timing. This picture data D1 of the positive polarity is the inherent picture data allotted to the forward side scanning line. At the second timing, a selection pulse is applied to the scanning electrode X2 to produce plasma discharge between the electrode X2 and scanning electrodes lying on both sides of the scanning electrode X2. Considering the central discharge channel 5*b*, plasma discharge is produced across the scanning electrodes X1 and X2 to form a second backward side scanning line. It is in this second backward side scanning line that the next picture data D2 of the positive polarity is written. That is, the picture data D1 of the positive polarity, written in the backward side scanning line at the first timing is rewritten to the next inherent picture data D2 of the positive polarity at the second timing. If a selection pulse is applied to the center scanning electrode X1, plasma discharge is spread to the entire discharge channel 5*b*, whereas, if the selection pulse is applied to the scanning electrodes X0, X2 lying directly below the partition 7, plasma discharge is generated in a substantially one-half portion of the discharge channel 5. Thus, the picture data D1, written in the forward side scanning line at the first timing, is held unchanged when the timing is the second timing, whereas the picture data D1 written in the backward side scanning line is rewritten to the inherent picture data D2 at the second timing. As may be apparent from the foregoing description, picture data of the same polarity is written in the two scanning lines, that is the forward and backward side scanning lines, belonging to the same discharge channel. For example, picture data D1 and D2 of the positive polarity is written in the two scanning lines lying on the forward and backward sides of the center discharge channel 5*b*. In the two scanning lines, that is the forward and backward side scanning lines, belonging to the neighboring discharge channel 5*c*, there is written picture data D3, D4 of the opposite polarity (negative polarity).

FIG. 5A illustrates the results of writing of picture data according to the present invention and FIG. 5B illustrates the results of writing of data according to the prior art technique. As shown in FIG. 5A, first picture data D1 is written in the forward side scanning line in the discharge channel 5 to which are allotted the scanning electrodes X1, X2. The first and second picture data D1 and D2 are both of positive polarity. The arraying pitch of a scanning line is indicated by P. Since the discharge channel 5*b* includes two scanning lines, that is forward and backward scanning lines, the arraying pitch is 2P. In the neighboring discharge channel 5*c*, to which are allotted the scanning lines X3 and X4, third picture data D3 is written in the first scanning line, while fourth picture data D4 is written in the second scanning line. The third and fourth picture data D3, D4 are both of negative polarity. In a similar manner, picture data corresponding to two scanning lines is written in each discharge channel.

In the prior art, each scanning line is allocated to each discharge channel 5, as shown in FIG. 5B. This scanning line is constituted by paired electrodes, that is an anode A and a cathode K. If the scanning line density is equal to that in the present invention, the arraying pitch P of the discharge channel 5 is one-half that of the present invention. Comparison of FIGS. 5A and 5B reveals that the number of the barrier ribs 7 as well as that of the scanning electrodes can be reduced to one-half those in the conventional technique, thereby improving the productivity and the open area ratio. The number of the barrier ribs 7 is preferably as small as possible since these tend to obstruct the angle of field of view. In the inventive structure, shown in FIG. 5A, the angle of field of view is enlarged because the number of the barrier ribs 7 is one-half that of the conventional structure shown in FIG. 5B.

FIG. 6 is a circuit diagram showing the entire structure of a plasma addressed display device according to the present invention. As shown therein, the present plasma addressed display device is basically made up of a panel 0, a signal circuit 21, a scanning circuit 22 and a control circuit 23. The panel 0 is of a layered structure comprised of plasma cells having scanning electrodes X0 to Xn arranged in a row configuration and display cells having signal electrode s Y0 to Ym arranged in a column configuration, with the plasma cells and the display cells being superimposed together. The scanning circuit 22 sequentially applies selection pulses across the scanning electrodes X0 to Xn to scan the display cells. The signal circuit 21 sends picture data to the signal electrodes Y0 to Ym in synchronism with the above-mentioned scanning to write picture data in terms of a set of the scanning lines 51, 52 as a unit. The control circuit 23 controls the synchroneity of the signal circuit 21 and the scanning circuit 22. The plasma cells include discharge channels 5 in reciprocally isolated rows. To the respective discharge channels 5, charged with dischargeable gas, plural scanning electrodes are allotted. The scanning circuit 22 sequentially applies selection pulses to the plural scanning electrodes, such as X1 and X2, allotted to a given discharge channel 5, to produce electrical discharge to form at least two scanning electrodes, that is the forward and backward scanning lines 51, 52, into a sole discharge channel 5. The signal circuit 21 writes picture data of the same polarity to the two scanning lines, that is the forward and backward lines 51, 52, belonging to a sole discharge channel 5, while writing picture data of the opposite polarity to the scanning line belonging to the neighboring discharge channel to effect AC driving of the display cells.

In a specified embodiment, the discharge channel 5 is made up of a pair of barrier ribs delimiting a row-like space, scanning electrodes, such as X0 and X2, arrayed below the barrier ribs, and a center scanning electrode X1 arranged intermediate between the scanning electrodes X0 arid X2 in this row-like space. The forward side sole scanning line 51 is delimited intermediate between the scanning electrode X0 and the center scanning electrode X1, arranged on the bottom side of a given barrier rib, whilst the backward side scanning line 52 is delimited intermediate between the scanning electrode X2 and the center scanning electrode X1, arranged on the bottom side of another barrier rib. In this case, the scanning circuit 22 applies selection pulses to the center scanning electrode X1 to produce electrical discharge in substantially the entire discharge channel 5, while applying selection pulses to the scanning electrode X2 arranged on the lower side of the other barrier rib to produce electrical discharge in substantially the latter half of the discharge channel 5 to form the two scanning lines 51, 52 into a sole discharge channel 5 in conjunction with a former half of a neighboring discharge channel.

As characteristic of the present invention, the signal circuit 21 corrects the picture data D2 written in the backward side scanning line 52 of the two scanning lines, that is the forward and backward side scanning lines 51, 52, which is affected by polarity switching, in meeting with the picture data D1 written in the forward side scanning line 51 not affected by the polarity switching. This characteristic of the present invention is hereinafter explained in detail. Referring to FIG. 4B, picture data D1 of positive polarity is written on the forward side scanning line of the discharge channel 5*b*, while picture data D2 of positive polarity are similarly written on the backward side scanning line thereof. Therefore, the picture data D1 and D2 are of the same polarity, so that there is substantially no risk of the previously written picture data D1 being affected by the subsequently written picture data D2. However, after the picture data D2 of the positive polarity are written in the backward side scanning line of the discharge channel, polarity switching occurs, so that picture data D3 of the negative polarity are written in the forward side scanning line of the next discharge channel 5*c*. At this time point, the probability is high that metastable particles produced by plasma discharge be left in the discharge channel 5*b*, with the discharge channel 5*b* not being completely in the off-state. The result is that the picture data D3 of the negative polarity, which should be written in the forward side scanning line of the discharge channel 5*c*, is written in the backward side scanning line of the discharge channel 5*b* in the slightly on state, thus operating to cancel the previously sample-held picture data D2 of the positive polarity. Since the picture data D2 of the positive polarity are cancelled by the picture data D3 of the negative polarity, the pixel in which has been written the pixel data D2 is lowered in luminance from the inherent luminance if the display cell 1 of the normally black mode is employed. Stated differently, even if the picture data D1 and D2, written in the sole discharge channel 5, are of the same magnitude, there is produced difference in luminance between the forward side and backward side scanning lines. In the case of the normally black mode, the posterior side scanning line is lower in luminance than the previous scanning line.

Figure 7:
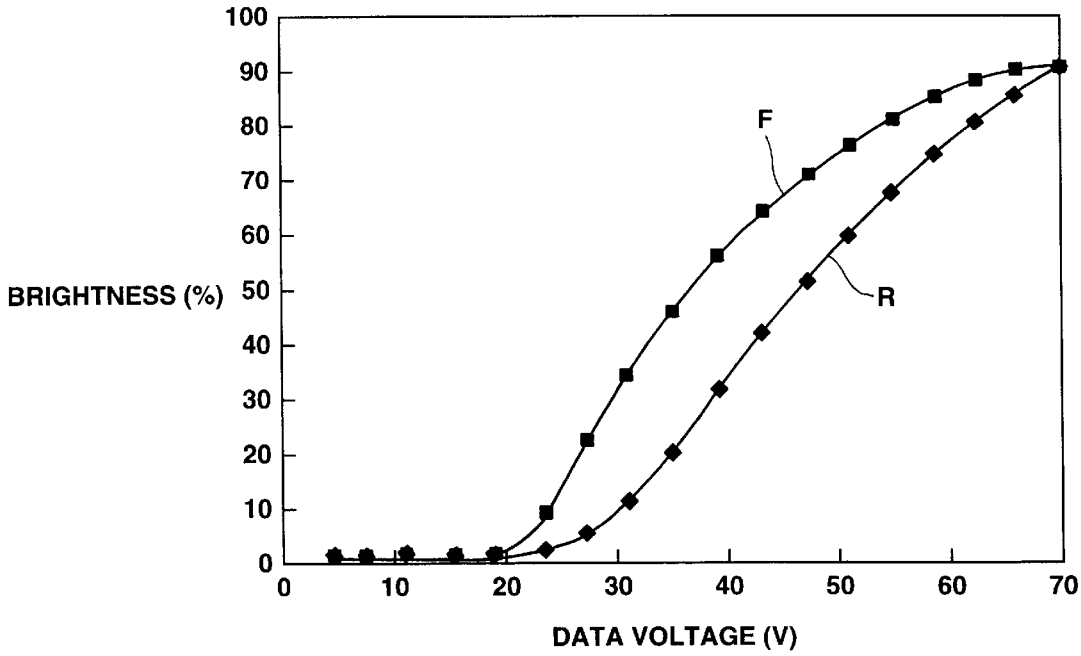
FIG. 7 is a graph showing correction characteristics of the picture data of the present invention.

In order to prevent this from occurring, the signal circuit 21 corrects the picture data written in the backward side scanning line affected by the polarity switching in meeting with the picture data written in the previous scanning line not affected by the polarity switching. A specified example of such correction is shown in FIG. 7. In the graph of FIG. 7, a curve F denotes luminance characteristics of the forward side scanning line, whereas a curve R denotes luminance characteristics of the backward side scanning line. In the graph of FIG. 7, the relative luminance is plotted on the ordinate in units of percent, and the data voltage applied to the signal electrode based on the picture data are plotted on the abscissa. In the present example, the mode is the normally black mode, with luminance increasing with the increased data voltage. For example, with the data voltage of 40 V, the forward side scanning line, not affected by the polarity switching, the luminance value is approximately 60%. With the backward side scanning line, the luminance value is as low as slightly above 30% due to the effect of the polarity switching. In order to eke out this decrease in the luminance value, it suffices if the data voltage of approximately 50 V, rather than 40 V, is applied to the backward side scanning line. By so doing, the luminance value of 60% may be achieved even for the backward side scanning line.

Figure 8:
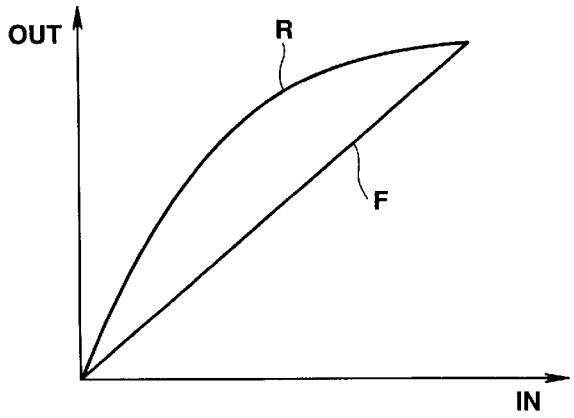
FIG. 8 is a graph showing another example of the correction processing for picture data of the present invention.

FIG. 8 shows a graph showing another example of the correction processing carried out in the signal circuit. In the present example, the picture data inputted from outside is previously rewritten and outputted to adjust the difference in luminance between the two scanning lines, that is the forward side and backward side scanning lines. Referring to the curve F in the graph, input data directly is used as output data insofar as the picture data written in the forward side scanning line is concerned. Conversely, insofar as the picture data to be written in the backward side scanning line is concerned, input data shifted to a higher side are used as output data to eke out the decrease in luminance caused by the polarity switching at the outset.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A plasma addressed display device comprising:

a flat panel having plasma cells having scanning electrodes in a row configuration and display cells having signal electrodes in a column configuration, said plasma and display cells being superimposed together, a scanning circuit for sequentially applying selection pulses to said scanning electrodes to scan said display cells, and a signal circuit for supplying picture data to said signal electrodes in synchronism with said scanning to write picture data from one scanning line to another, wherein at least two scanning lines are formed in a same discharge channel in the plasma cells, and wherein the signal circuit writes picture data of a positive polarity to the same discharge channel and writes picture data of a negative polarity to a subsequent discharge channel so as to effect AC driving of the display cells, and writes picture data of which luminance is corrected to a backward side scanning line of at least two scanning lines formed in each discharge channel.

2. The plasma addressed display device according to claim 1, wherein said discharge channel includes a pair of barrier ribs that define a space in a row configuration and a center scanning electrode arranged between two scanning electrodes of the discharge channel, and wherein a forward side scanning line is defined between a first of the scanning electrode arranged on a bottom side of one of said barrier ribs and the center scanning electrode and a backward side scanning line is defined between the center scanning electrode and a second of the scanning electrode arranged on a bottom side of the other of said barrier ribs.

* * * * *